United States Patent [19]

Admire, Jr.

[11] Patent Number: 4,796,015

[45] Date of Patent: Jan. 3, 1989

[54] COMBINATION ELECTRIC CLOCK AND SMOKE DETECTOR

[76] Inventor: Woodrow W. Admire, Jr., 3717 Garner, Kansas City, Mo. 64124

[21] Appl. No.: 29,246

[22] Filed: Mar. 23, 1987

[51] Int. Cl.[4] ..... G08B 23/00

[52] U.S. Cl. ..... 340/693; 340/628; 340/636

[58] Field of Search ..... 340/693, 628–630, 340/636; 368/10–12

[56] References Cited

U.S. PATENT DOCUMENTS

| | | | |
|---|---|---|---|
| 1,240,618 | 9/1917 | Stevens | 116/102 |
| 3,747,331 | 7/1973 | Nyberg | 368/11 |
| 4,037,206 | 7/1977 | Dobrzanski et al. | 340/693 X |
| 4,090,178 | 5/1978 | Norris | 340/693 X |
| 4,186,389 | 1/1980 | Flittie | 340/628 |
| 4,236,822 | 12/1980 | Jaretsky et al. | 340/628 X |
| 4,321,591 | 3/1982 | Vieweg | 340/628 X |
| 4,419,658 | 12/1983 | Jarosz et al. | 340/693 X |
| 4,471,346 | 9/1984 | Nelson et al. | 340/630 X |
| 4,540,980 | 9/1985 | Porco | 340/693 X |
| 4,548,274 | 10/1985 | Simpson | 292/144 X |
| 4,611,200 | 9/1986 | Stilwell | 340/628 |
| 4,623,878 | 11/1986 | Schoenwetter | 340/693 X |

*Primary Examiner*—Glen R. Swann, III
*Assistant Examiner*—Thomas J. Mullen, Jr.
*Attorney, Agent, or Firm*—Hovey, Williams, Timmons & Collins

[57] ABSTRACT

A compact combination clock and smoke alarm is provided in which cessation of clock operation indicates inoperativeness of the smoke alarm and in which the smoke alarm structure is concealed from view by the clockface. The preferred assembly includes a housing having parallel, spaced-apart, front and rear walls coupled by an intermediate wall having air vents, all defining a chamber within the housing. A battery, clock unit, and smoke alarm are mounted within the chamber and clock hands are visible in relation to the front face of the front wall, the front wall having a surface area greater than that of the rear wall so that the front wall visually covers the rear and intermediate walls.

3 Claims, 1 Drawing Sheet

Fig. 1.
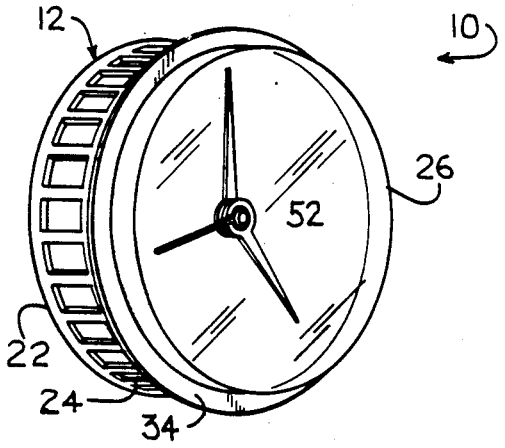
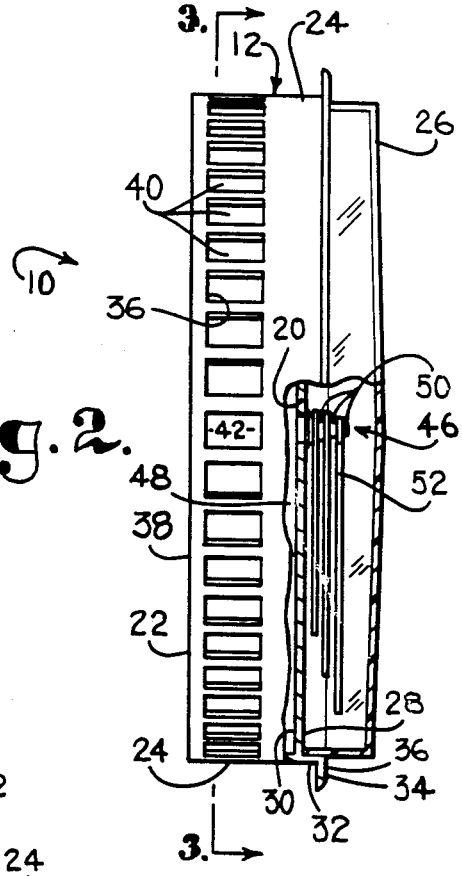
Fig. 2.
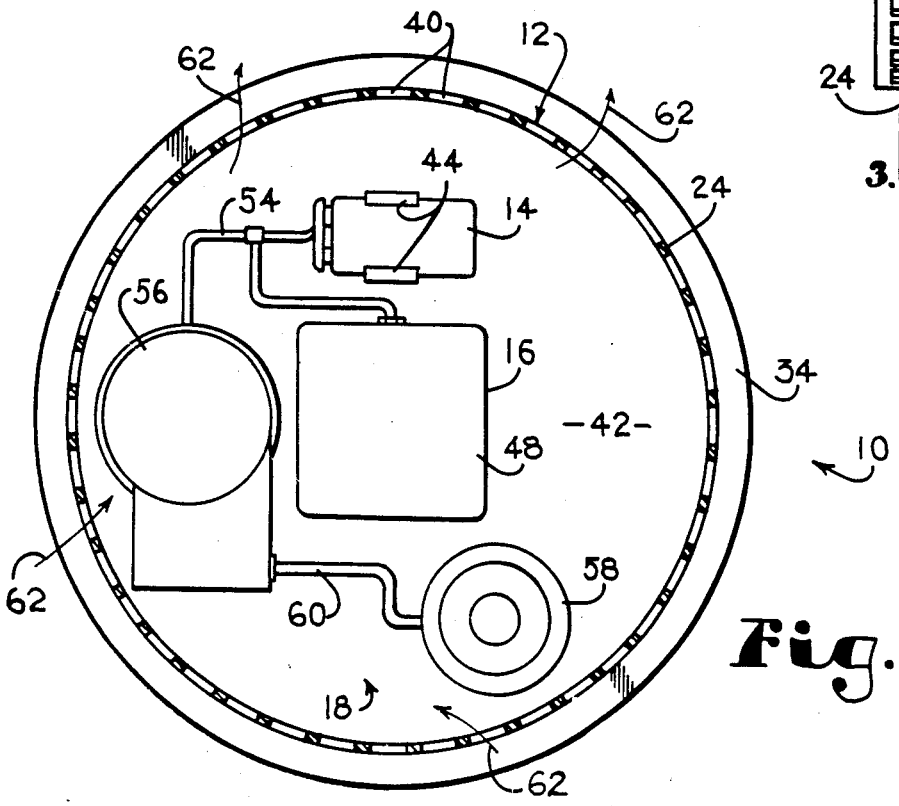
Fig. 3.

COMBINATION ELECTRIC CLOCK AND SMOKE DETECTOR

BACKGROUND OF THE INVENTION

1. Field of the Invention

This invention relates to a compact combination clock and smoke alarm assembly in which cessation of the clock operation indicates inoperativeness of the smoke alarm and in which the smoke alarm is concealed from view by the front wall of the assembly. More particularly, it is concerned with an assembly having front, rear, and intermediate walls forming a housing with a chamber therein, a battery, clock unit, and smoke alarm mounted in the chamber, clock hands visible in relation to the front face of the housing, air vents defined in the intermediate wall, and the front wall having a larger surface area than the rear wall in order to conceal the rear and intermediate walls from view.

2. Description of the Prior Art

The prior art discloses various devices for incorporating a smoke or fire detector with an alarm clock. For example, U.S. Pat. No. 4,321,591, which is incorporated herein by reference, discloses specific electric circuitry for incorporating a smoke or gas detector, an alarm clock, and a burglar alarm with a common battery as power source.

As an additional example, U.S. Pat. No. 4,540,980, which is incorporated herein by reference, discloses a smoke detector alarm and a clock incorporated into a single extensible, telescoping housing which may be closed to seal off the smoke sensor. The device disclosed in the U.S. Pat. No. 4,540,980 also includes a motion sensing intrusion alarm and a housing adapted to clip to a door for usable as a portable room security device.

The prior art does not reveal, however, means for incorporating a smoke alarm and clock in a single, compact, aesthetically configured housing readily mountable to a vertical wall surface and in which the front wall of the housing is configured to visually cover the other walls of the housing.

SUMMARY OF THE INVENTION

The problems as outlined above are solved by the clock and smoke alarm assembly in accordance with the present invention. That is to say, the clock and smoke alarm assembly hereof can be readily mounted to a vertical wall surface and when so mounted, the time-of-day indicia are observable in relation to the front wall of the assembly housing, and the front wall visually covers the other walls to enable an aesthetic configuration of the assembly.

Broadly speaking, the clock and smoke alarm assembly hereof comprises a housing including a front wall, rear wall, and an intermediate closed wall coupling the front and rear walls in a spaced-apart, parallel relationship whereby the walls define a chamber within the housing, and whereby the housing is mountable to a vertical surface. When mounted to a vertical surface, the rear surface of the rear wall is in abutting relationship therewith and the front face of the front wall faces outwardly from the vertical surface. A battery is mounted within the chamber along with a battery-powered clock and smoke alarm both of which are electrically coupled with the battery. The clock includes time-of-day indicia coupled with a clock unit which are visible in relation to the front face of the front wall. The battery, clock, and smoke alarm cooperate so that cessation of operation of the time-of-day indicia provides an indication that the battery is discharged and that the smoke alarm is inoperable due to lack of operating power from the battery. The intermediate wall has a plurality of air vents defined therein and communicating with the chamber for allowing ambient air to flow through the chamber and to come into contact with the smoke alarm in sufficient quantity to be representative of the ambient air surrounding the housing. The front wall has a surface area greater than the surface area of the rear wall whereby the front wall visually covers the rear wall and intermediate walls when viewed from a location directly in front of the front face.

Preferably, the front wall is configured to include a continuous circumscribing rim visually covering the rear and intermediate wall with the rim being parallel to and outwardly offset relative to the front face. Desirably, the clock is an analog clock and the time of day indicia include analog clock hands.

BRIEF DESCRIPTION OF THE DRAWINGS

FIG. 1 is a perspective view of the combination clock and smoke alarm assembly;

FIG. 2 is a side elevational view of the assembly with a portion of the housing cut away;

FIG. 3 is a sectional view along line 3—3 of FIG. 2.

DESCRIPTION OF THE PREFERRED EMBODIMENT

Referring now to the drawing figures, clock and smoke alarm assembly 10 broadly includes housing 12, battery 14, clock 16, and smoke alarm 18.

Housing 12 includes front wall 20, rear wall 22, intermediate wall 24, and cover 26.

Circular front wall 20 is preferably composed of wood in order to present an aesthetically pleasing appearance but may be advantageously composed of synthetic resin material or metal. Front wall 20 presents front face 28 and rear face 30, includes annular wall portion 32 extending outwardly from front face 28, and includes circumscribing rim 34 which presents an outward surface 36 parallel to but outwardly offset from front face 28 (FIG. 2).

Rear wall 22 is preferably circular in the preferred embodiment and composed of synthetic resin material. Rear wall 22 includes a conventional mounting hole (not shown) defined therein which is adapted for coupling with a nail or wall hook driven in a vertical wall surface. Rear wall 22 additionally presents front surface 36 and rear surface 38.

Closed intermediate wall 24 is preferably composed of synthetic resin material and integrally formed with rear wall 22. Intermediate wall 24 couples front surface 36 with rear face 30 so that front and rear walls 20, 22 are coupled in a spaced-apart, parallel relationship with intermediate wall 24 disposed therebetween and orthogonal to both. Intermediate wall 24 also includes a plurality of rectangularly shaped and spaced-apart air vents 40 defined therearound and through.

Front, rear, and intermediate walls 20, 22, and 24 together define chamber 42 within housing 12. Vents 40 communicate with chamber 42.

FIG. 2 discloses that front wall 20 including rim 34 has a surface area greater than that of rear wall 22. In this way, rim 34 visually covers rear wall 22 and intermediate 24 from view by an observer located directly in front of front face 28. In this way, clock and smoke alarm assembly 10 can be configured to present an aesthetically pleasing appearance by visually covering much of the functional structure of the assembly without impairing those functions. Those skilled in the art will appreciate that front wall 20 can be made with a much greater surface area than that shown in drawing figures in order to provide greater visual concealment of rear wall 22 and intermediate wall 24.

Battery 14 is a conventional 9-volt battery releasably coupled to a rear face 30 within chamber 42 by a pair of inwardly biased holding clips 44.

Conventional battery-powerable clock 46 includes clock unit 48, clock shafts 50, and clock hands 52. Clock unit is mounted to rear face 30 within chamber 42 with shafts 50 centrally extending through front wall 20 and with conventional hour, minute and second hands 52 respectively coupled thereto. Conventional power cable 54 electrically couples clock 16 and battery 14 for delivery of operating power from battery 14 to clock 16.

Conventional smoke alarm 18 includes smoke sensor 54 and sound unit 56. Additionally, smoke sensor 54 may conventionally include a high temperature sensing function. Power cord 54 also electrically couples battery 14 and smoke alarm 18 for delivery of operating power thereto. Smoke sensor 56 and sound unit 58 are mounted to rear face 30 within chamber 42. Conventional electrical cord 60 electrically couples sensor 56 with unit 58 for transmitting operating power thereto.

In the use of clock and smoke alarm assembly 10, it is first mounted to a vertical wall surface according to conventional techniques optionally using the mounting hole defined in rear wall 22. Assembly 10 is thus mounted with rear surface 38 in abutting engagement with the vertical wall surface whereby clock hands 52 are visible against the background of front face 28 of front wall 20.

With assembly 10 so mounted, natural convection air flow represented by arrows 62 in FIG. 3 occurs whereby ambient air surrounding assembly 10 enters and exits through air vents 40 and through chamber 42 where the air comes into contact with sensor 56. The total surface area represented by vents 40 needs to be sufficiently great so that the ambient air coming into contact with sensor 56 is representative of the ambient air surrounding assembly 10. This ensures that smoke alarm 18 is rapidly responsive to any smoke or temperature rise in the ambient air.

In the event smoke or excessive temperature are detected by smoke alarm 18, sound unit 58 is activated to sound an audible alarm. Vents 40 also function to allow transmission of the sound from sound unit 58 to the surrounding area to warn those in the vicinity of smoke or excessive temperature.

Eventually, battery 14 will become discharged at which point clock 16 will cease to operate. Preferably, clock hands 52 include a "sweep" second hand and the cessation of movement of this hand is readily apparent when battery 14 becomes discharged. Even without a sweep second hand, an observer will still note the cessation of clock operation. When such is observed, the viewer also knows that smoke alarm 18 is also nonfunctional for lack of operating power from battery 14. Thus, clock 16 provides a visual indication prompting the replacement of battery 14. Additionally, most conventional smoke alarms randomly sound short alarm bursts on sound unit 58 when the battery voltage begins to sag near the end of its recharge life.

FIG. 1 best illustrates that the configuration of assembly 10 is such that rear wall and intermediate wall 24 are visually covered by front wall 20 and, in particular, by rim 34 when viewed from a location directly in front of front face 28. In this way, the smoke alarm function of assembly 10 is not aesthetically obtrusive and is somewhat disguised in addition to being contained within a very compact unit. Those skilled in the art will appreciate that front wall 20 can be configured without rim 34 and can be made as large as desired in order to provide sufficient visual coverage of rear wall 22 and intermediate wall 24.

The present invention contemplates other variations in the preferred embodiment herein described. For example, while an analog clock display with analog clock hands is preferred, a digital display visible in relation to front face 28 could be incorporated additionally or in place of the analog display of hands 52. Furthermore, the present invention contemplates virtually unlimited aesthetic configurations of housing 12 while still providing that the surface area of front wall 20 is greater than that of rear wall 22 in order to visually cover rear wall 22 and intermediate wall 24. Finally, assembly 10 can be provided with a conventional means for receiving transformed and rectified power from a standard household 120 V.A.C. source according to known conventional techniques.

Having thus described the preferred embodiment of the present invention, what is claimed as new and desired to be secured by Letters Patent is:

1. A clock and smoke alarm assembly comprising:

a housing having walls defining an internal chamber, said walls including a front wall presenting a front face;

battery receiving means for receiving battery means within said chamber and for electrically coupling with said battery means;

an electrically powerable clock unit received within said chamber and including time-of-day indicia visible in relation to said front face;

an electrically powerable smoke alarm received within said chamber; and means electrically coupling said clock unit and smoke alarm with said battery receiving means for electrically powering both said clock unit and smoke alarm from said battery means as the sole source of electric power for cooperation among said battery means, clock unit, and smoke alarm so that cessation of operation of said clock unit due to depletion of said battery means provides visual indication that said smoke alarm is also inoperable due to said depletion, said time-of-day indicia including analog clock hands.

2. The assembly as set forth in claim 1, said walls including a sidewall, said front face comprising a clock face, said clock face including a continuous, outwardly extending, annular circumscribing rim for visually concealing said sidewall when said assembly is viewed from a location in front of said clock face.

3. The assembly as set forth in claim 1, said walls including a rear wall spaced-apart from said front wall and a circumscribing, apertured sidewall joining said front and rear walls, said sidewall having sufficient apertured open area for permitting representative ambient air flow into said chamber.

* * * * *